US008511026B2

(12) United States Patent
Zamora Loureiro et al.

(10) Patent No.: US 8,511,026 B2
(45) Date of Patent: Aug. 20, 2013

(54) DRYWALL AND CLADDING CONSTRUCTION SYSTEM

(75) Inventors: Enrique Zamora Loureiro, Madrid (ES); Juan Antonio Garcia Prades, San Joan de Moró (ES)

(73) Assignees: Uralita Iberia, S.L., Madrid (ES); Ceramica Saloni, S.A., San Joan de Moro, Castellon (ES)

( * ) Notice: Subject to any disclaimer, the term of this patent is extended or adjusted under 35 U.S.C. 154(b) by 57 days.

(21) Appl. No.: 13/148,617

(22) PCT Filed: Feb. 8, 2010

(86) PCT No.: PCT/ES2010/000052
§ 371 (c)(1),
(2), (4) Date: Aug. 9, 2011

(87) PCT Pub. No.: WO2010/089434
PCT Pub. Date: Aug. 12, 2010

(65) Prior Publication Data

US 2011/0308196 A1 Dec. 22, 2011

(30) Foreign Application Priority Data

Feb. 9, 2009 (WO) ..... PCT/ES2009/000073

(51) Int. Cl.
*E04B 2/08* (2006.01)

(52) U.S. Cl.
USPC ..... 52/506.05; 52/481.1; 52/475.1; 52/481.2; 52/489.1; 52/489.2

(58) Field of Classification Search
USPC ..... 52/506.05, 475.1, 481.1, 479, 481.2, 52/489.1, 489.2, 762
See application file for complete search history.

(56) References Cited

U.S. PATENT DOCUMENTS

| | | | | |
|---|---|---|---|---|
| 1,960,961 | A | 4/1932 | Thomas | |
| 2,058,386 | A * | 10/1936 | Parsons | 52/290 |
| 3,753,325 | A | 8/1973 | Stanley et al. | |
| 3,925,948 | A * | 12/1975 | Sauer et al. | 52/481.2 |
| 7,661,237 | B2 * | 2/2010 | Jakob-Bamberg et al. | 52/506.08 |
| 2005/0102969 | A1 | 5/2005 | Burg | |

FOREIGN PATENT DOCUMENTS

| | | |
|---|---|---|
| DE | 20 2006 015 903 U1 | 3/2007 |
| EP | 0 367 768 | 4/1990 |
| EP | 0364768 A1 | 4/1990 |
| ES | 2 243 426 | 12/2005 |
| FR | 2 657 449 | 7/1991 |
| FR | 2 723 125 | 2/1996 |
| WO | WO 95/32346 | 11/1995 |

OTHER PUBLICATIONS

International Search Report for International Application No. PCT/ES2010/000052 mailed Jun. 16, 2010.

* cited by examiner

*Primary Examiner* — Brian Glessner
*Assistant Examiner* — Beth Stephan
(74) *Attorney, Agent, or Firm* — Merchant & Gould P.C.

(57) ABSTRACT

A cladding and drywall construction system is based on a load-bearing structure (11), large-surface flat constructive elements (1) which have joining pieces including male elements (6), anchoring pieces of the male elements to the load-bearing structure and fixed profiles (20) which are anchored to the load-bearing structure (211) and sliding profiles (14) which are mounted on the fixed profiles (20), which can move along them. The fixed profiles (20) and the sliding profiles (14) have, respectively, opposite holes (7) and openings (5), through which the male elements (6) are inserted for their blocking by the openings (5), through the sliding movement of the sliding profiles (14).

17 Claims, 13 Drawing Sheets

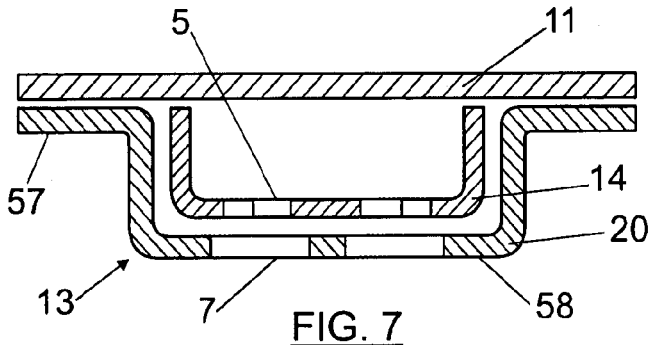
FIG. 7
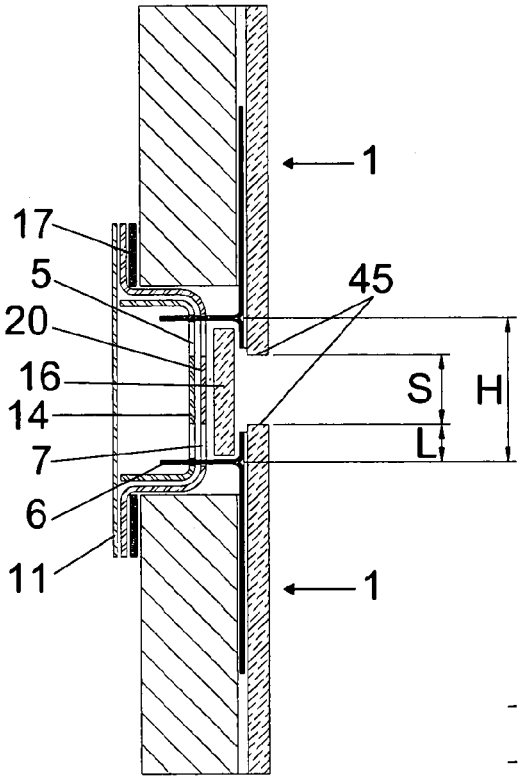
FIG. 8
FIG. 9
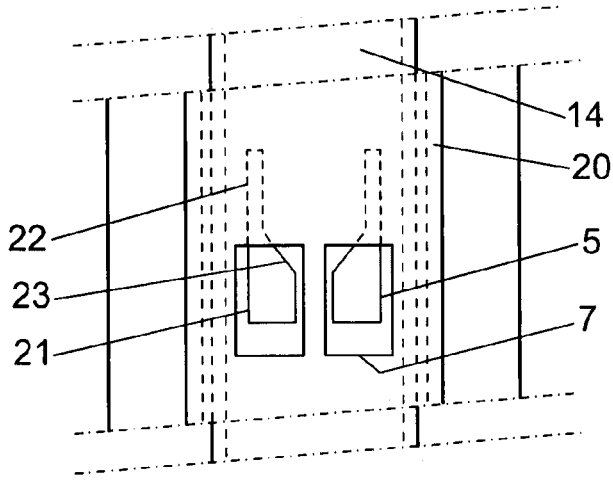

DRYWALL AND CLADDING CONSTRUCTION SYSTEM

This application is a National Stage Application of PCT/ES2010/000052, filed 8 Feb. 2010, which is a continuation of International Application Serial No. PCT/ES09/000,073, filed 9 Feb. 2009 and which applications are incorporated herein by reference. To the extent appropriate, a claim of priority is made to each of the above disclosed applications.

FIELD OF THE INVENTION

The present invention refers to a drywall and cladding construction system, based on the use of constructive elements with a large surface with respect to their thickness, comprising several layers, with an outer ceramic layer, which enables to increase the cost-effectiveness of the work, reducing the execution time thereof, with an excellent aesthetic finish and having excellent maintenance conditions and renovation and alteration capabilities.

More particularly, the construction system of the invention is based on the use of constructive elements of the type indicated and a load-bearing structure, the constructive elements having joining pieces which fix the load-bearing structure through intermediate anchoring pieces.

By drywall or cladding we mean those the construction of which does not require the application of humid paste, such as mortar, cement, plaster, etc.

BACKGROUND OF THE INVENTION

There are known construction systems, both drywall and cladding for walls and alike based on flat constructive elements, with large surfaces with respect to their thickness, comprising several layers, whose constructive elements are fixed on a load-bearing structure. The constructive elements are mounted on the load-bearing structure through intermediate fastening pieces of different types.

Construction systems with the aforementioned constitution are described, for example, in ES 2243426, DE 2026015903U, and US 2005102969. In all cases the intermediate fastening pieces consist of parts or components which are added to the construction of the partition or cladding during its construction, which requires manipulating a large number of components. On the other hand, making the visible surface of all constructive elements of the same face or wall is located in the same plane, and also with a constant separation between consecutive constructive elements, causes positioning or levelling problems when the construction systems described in the abovementioned documents is used.

DESCRIPTION OF THE INVENTION

The object of the present invention is a construction system which satisfactorily solves the aforesaid limitations, in a simple manner and not requiring skilled labour both at the installation and along the useful life of the partition or cladding.

The construction system of the invention comprises a load-bearing structure, a plurality of constructive elements having joining pieces, and a plurality of anchoring pieces to fix the joining pieces of the construction elements to the load-bearing structure.

The load-bearing structure can be an existing structure, such as a brick partition or a laminated plasterboard, to which a cladding would be applied according to the system of the invention, or a new construction structure, typically metallic or wooden, which would allow the formation of a cladding or partition. In some cases, the anchoring pieces will be incorporated to the load-bearing structure. In the case of existing structures, the anchoring pieces will be directly incorporated on-site, while in the case of the newly-created structures the anchoring pieces can be built-in on said structures during the manufacturing.

The load-bearing structure can be constituted with horizontal elements, which we will call floor and roof profiles, and by vertical elements, which we will call vertical profiles. At the manufacturing of a drywall, the horizontal elements act as structural frame for the drywall, delimiting the place where it will be built, which is the first step for the construction of the drywall, while the vertical profiles are located in vertical position between the floor and roof profiles which form the horizontal elements.

In the case of the load-bearing structures characteristic of the construction system, in one of its variants, additional anchoring pieces can be incorporated to allow the installation of an additional inner plate to the drywall, which is normally a laminated plasterboard, one of whose functions is to provide support to the inner installations of the drywall or support the functional elements thereof. Likewise, the floor and roof profiles can comprise paths which allow the perimeter enclosure of the aforementioned plasterboard, securing the insulation against sound and thermal bridges.

Also, in the case of load-bearing structures and even existing structures, heavy loads which have to be hung from the drywall would be hung from an auxiliary structure, fixed either to the existing structure or to the new load-bearing structure, to that end special parts would be used which would go through the constructive element.

The profiles of the load-bearing structure, both floor and roof horizontal ones and vertical ones, in one of their variants, can incorporate elastic joints which act as sealing means and insulation of the junctions between the constructive elements and the profiles of said load-bearing structure.

Also, the load-bearing structure can be duplicated, that is, it can be double in order to obtain drywalls with many benefits, making both parts independent.

In the case of double load-bearing structures, it is possible to include, between them, safety sheets, such as metallic sheets or metallic mesh, which prevent access from one side to the other of the drywall.

As regards the constructive elements, they have a large surface with respect to their thickness and they comprise a reduced-thickness cladding sheet, which will define the visible surface; an inner layer for structural reinforcement, which adds the structural and bearing strength of the construction element; and an intermediate joining layer. These constructive elements will have joining pieces for their mounting on the load-bearing structure through intermediate anchoring pieces.

The constructive pieces used in the system of the invention are large, for example, they have surfaces greater than 2 $m^2$, they have a reduced thickness and they are manufactured in an industrialized manner so that the joining pieces are built into the constructive elements in the factory forming an indivisible part.

In order to improve the benefits offered by the drywall or cladding, the constructive elements can incorporate in an industrialized manner additional layers, such as vapour barrier layers, thermal and sound insulation layers and any other type of layer which improves their benefits.

The constructive elements, as it has been indicated, include the joining pieces which are integrally built-in said constructive elements.

In order for the system to be watertight, the constructive elements can have a perimeter joint, which can be plastic, metallic or adhesive, so that the interior of the construction system is insulated against humidity, guaranteeing the sealing, both against humidity and against possible thermal and sound bridges.

According to the invention, the anchoring pieces, for the fixing of the constructive elements joining pieces to the load-bearing structure, are constituted by an equal number of fixed profiles and sliding profiles. The fixed profiles have female elements in the form of holes and are fixed to the load-bearing structure, preferably in a vertical position, for example by means of screws. As regards the sliding profiles, each one of them is longitudinally mounted on a fixed profile, and can be moved along it and has openings, whose number and position coincide with the holes of the fixed profile. Each one of the openings of the mobile profiles has two contours with different width consecutively located in the direction of the sliding profile movement.

As regards the joining pieces of the constructive elements, they have male elements, whose number and position coincide with the openings of the sliding profiles and the holes of the fixed profiles. The male elements will have formations capable of being inserted in the wider contour of the openings, but retained by the narrower contour thereof. The male elements will be accessible from the rear of the constructive elements and are intended to be inserted through opposite openings and holes, when the wider contour of the openings faces the holes and the male elements. According to a preferred embodiment, the joining pieces of the constructive elements are constituted by at least one flat stock fixed to the constructive elements, through a portion thereof, in a direction parallel to the plane constituting the visible surface of said constructive elements, and which has the male elements.

The sliding profiles can be longitudinally slid with respect to the fixed profiles between an inactive position, in which the wider contour of the openings of the sliding profiles faces the holes of the fixed profiles, so that the male elements of the joining pieces of the constructive elements, with their formations, go freely through said openings and holes, and a retention position, in which the narrower contour of the openings faces the holes of the fixed profiles, covering in a tight manner the formations of the male elements to prevent their release.

The sliding profiles, which openings are provided with two contours with different widths, will guarantee the joining of the constructive elements, through the joining pieces of said constructive elements to the load-bearing structure while, at the same time, said joining pieces act as safety elements which prevent the constructive elements from separating or being released from the load-bearing structure. The fixed profiles of the anchoring pieces can be constituted by the vertical profiles themselves of the load-bearing structure, which would house the sliding profiles, or in other auxiliary fixed vertical profiles.

According to a preferred embodiment, the two contours of the openings of the sliding profiles will be joined by an intermediate section with variable width between the width of said contours. Preferably, the narrower width will be located on top of the wider contour.

According to an embodiment, the fixed profiles of the anchoring pieces are rectangular omega-shaped and are fixed through their flanges to the load-bearing structure, while the windows are located in their web. As for the sliding profiles, they have a rectangular U shape, with external dimensions slightly smaller than the internal ones of the fixed profiles, and they have the corresponding openings in their web. These U-shaped sliding profiles are mounted inside the fixed profile in the same direction, that is, with the aperture in the same direction, so that the web or bottom of both profiles are close to each other.

The flanges of the omega-shaped fixed profiles can be folded inwards 180°, defining opposite channels, whose outer walls support and are fixed to the load-bearing structure and also serve as retention pieces of the sliding profiles to prevent their release. To that end, the free edges of the side walls of the aliding profiles are separated from each other a distance greater than the free edges of the outer walls of the opposite channels of the fixed profiles, to define the retention pieces of said sliding profiles.

The male elements of the aforementioned joining pieces can consist of tongues in the form of hooks protruding in coplanar position from one of the longitudinal contours of each flat platten, all of them oriented to the same direction and being accessible by the rear of the constructive elements so that they can be inserted through the holes of the fixed profiles and openings of the sliding profiles, when said sliding profiles are in the inactive position, enabling to receive the coupling adjusted to the narrower contour of said openings to the bottom of the hook, when the sliging profile is displaced to its retention position. According to a characteristic of the invention, the bottom of the hook will be located at a fixed distance with respect to the outer visible surface of the constructive element, thus securing the coplanarity of the outer visible surface of all constructive elements which form the cladding.

The platten constituting the joining pieces will be closed, at least partially, in the constructive elements from the longitudinal edge opposite the one from which the coplanar tongues protrude. At least on one of the edges of the constructive elements and along it, one of the plattens will be closed as described, with all tongues in the form of hooks being aligned at the same distance from said edge. Also, at least one platten can be fixed along one or more intermediate lines of the constructive elements, with the same conditions as the flat platten(s) fixed on the edges of said constructive elements.

The flat platten of the joining pieces will be provided, preferably, from the fixing edge to the constructive elements, with transverse indentations whose length equals the part of the flat platten which is in contact with the constructive element. These indentations will delimit coplanar teeth which can be in the same direction or in opposite directions. The aforementioned transverse indentations will enable to cut the constructive elements in a direction perpendicular to the flat platten with blade tools, for example a cutter or a diamond glass cutter or a ceramic cutter type, since in the area coinciding with the flat platten the cut will be made coinciding with one of the transverse indentations thereof. To that end, each indentation has to be close to the next one.

The flat platten which forms the joining pieces can be completely flat or it can have transversal bends in different number and direction, to define a Z-shaped or W-shaped section, folded in the middle at 180°, etc.

The openings of the sliding profiles and the holes of the fixed profiles can be made in pairs in the web of said profiles, being the two openings and holes of each pair located at the same height in the corresponding profiles and also with the two openings and the two holes aligned in all pairs along the sliding profiles and fixed profiles, respectively. Also, the narrower contour of the openings of the sliding profiles will be as wide as the thickness of the tongues which form the male elements of the joining pieces to define, together with the aforementioned positioning of the openings and the holes, the separation and parallelism between adjacent edges of consecutive constructive elements.

In order to facilitate the mounting of male elements of the joining pieces in the anchoring pieces, the openings of the sliding profiles of these anchoring pieces can be extended laterally on the adjacent walls of said sliding profiles along the edges belonging to the wider contour of said openings. To the same end and if necessary, the holes of the fixed profiles can be extended laterally on the adjacent walls of said fixed profiles along the entire length of these holes.

For the movement of the sliding profiles with respect to the fixed profiles, between the inactive position and the retention position, said sliding profiles will have, between consecutive openings, first slit accessible through opposite larger second slit in the fixed profile. The first slit of the sliding profiles will be intended to receive the end of a propelling tool of the sliding profile, said tool will be inserted between consecutive constructive elements or through said constructive elements.

The anchoring pieces can be formed so that they enable the fixing of the constructive elements arranged in a corner. To that end, the web of the fixed profile and of the sliding profiles will have transversal crease which delimit the convex or concave angle on which the constructive elements are to be arranged. For example, the fixed profile and sliding profile can have three transversal creases on a right angle, a central one directed towards the outside and two symmetrical lateral ones arranged in a direction opposite the central crease. Also, the web of the fixed profile and the web of the sliding profile have only one transversal crease towards the outside or towards the inside depending on whether the panels are arranged forming a concave angle or a convex angle or a corner.

According to an embodiment variant, the fixed profiles of the anchoring pieces can have a flat central core, which ends longitudinally towards the same side in two opposite channels, while the sliding profile will have a rectangular omega-shaped section, whose width is approximately the same as the fixed profile, with the longitudinal flanges housed in the channels of said fixed profiles, to serve as guiding means in the movement of the sliding profile.

In order to guarantee the aesthetic continuity of the outer visible surface of the cladding or drywall, in the areas of the joints between constructive elements, the load-bearing structure can have incorporated decorative plattens of the same material and design as the outer plate of the ceramic cladding. This platten would also secure the sealing against thermal and sound bridges, and against fire.

The fixing of the constructive elements to the anchoring pieces can be performed in different ways:

- placing the constructive elements from bottom to top, that is, inserting the joining pieces of the constructive element in the anchoring pieces and lifting said constructive element so that the joining pieces of the constructive element are inserted in the anchoring pieces, leaving a hole next to the floor to house the skirting board, which can in turn protrude from the plane of the drywall or be within the drywall plane;
- placing the constructive elements from top to bottom, that is, inserting the joining pieves of the constructive element in the anchoring pieces and lowering said constructive element so that the joining pieces of the constructive element are inserted in the anchoring pieces, which enables to leave a hole next to the roof for the placement of decorative scotia;
- placing the constructive elements in the front, which would enable the constructive element to cover the entire space existing between the roof and the floor and later, activating the slide incorporated into the anchoring elements, to integrally fix the joining pieces of the constructive elements to the load-bearing structure.

The construction system described, given its use for the construction of drywalls, takes into account the incorporation of installations and functional improvements of the benefits of said drywalls. For this reason, the construction system uses the separation space between the two constructive elements which form the drywall required by the load-bearing structure, or the space purposefully enabled between the constructive element and the pre-existing load-bearing structure, to house the installations or layers of improvement of the drywall benefits.

To support the inner installations of the drywall, such as cable tubes, water ducts, communications, heating, air conditioning, etc., the construction system can incorporate an additional layer, as support layer for the installations. This layer, typically made of laminated plaster, enables to configure the installations before closing the construction system by means of the constructive elements and, later, to be able to extract and change the constructive elements without affecting the installations incorporated inside it.

In order to facilitate the housing and passage of the installation ducts through the interior of the construction system, the vertical profiles of the load-bearing structure have a series of die-cuts in their core. These die-cuts will be spaced out enough so that the structural strength of the beam of the vertical profiles is not affected and they will have a diameter so that all type of installation ducts can easily go through them.

In order to obtain sound and thermal insulation and fire protection, it is possible to incorporate extra layers of insulating material such as glass wool, rock wool or similar, or safety improvement layers such as metallic layers or metallic mesh, depending on the area of the building or house where said drywall is to be installed, that is, exit aisles, partitions, soundproof rooms, etc.

One of the characteristics of the construction system described in the present invention is its registrability. In this case, by registrability we mean the capacity to separate the constructive elements of the load-bearing structure and reinstall them in their position, in an independent manner and without affecting the adjacent constructive elements. This characteristic allows not only the easy aesthetic upgrade of constructive elements or their replacement if needed, but also the easy and fast access to the drywall installations, in case they need to be repaired or new installations need to be included, as well as the addition of new functional characteristics to the drywall; in case more thermal or sound insulation is required, new layers can be added which incorporate this new feature to it.

Another characteristic of this construction system is that the existence of an installation support layer allows the registrability of the system, the aesthetic renewal and upgrade of constructive elements without these operations affecting the functionality of the drywall, as the functional part of the drywall is independent from the aesthetic part thereof.

Thanks to the system thus described, an easy-to-install system is attained, as the constructive elements are large prefabricated elements which can be installed by means of a simple system on the joining means by unskilled workers. This easiness of mounting in turn provides a high installation efficiency (construction time savings), facilitating a massive use thereof, and an easy aesthetic upgrade, since, thanks to the aesthetic versatility offered by the external porcelain tile plate and the relatively low manufacturing and mounting cost, it is an advantage over the state of the art to offer the possibility of change every time the final user desires it.

BRIEF DESCRIPTION OF THE DRAWINGS

The attached drawings show a non-limiting example of an embodiment of the construction system of the invention. In the drawings:

FIG. 7 shows a transverse sectional view of the anchoring pieces used in the construction system of the invention.

FIG. 8 corresponds to the detail A of FIG. 3, at greater scale.

FIG. 9 shows an elevated frontal view of the anchoring pieces represented in FIG. 7.

DETAILED DESCRIPTION OF AN EMBODIMENT

Figure 1:
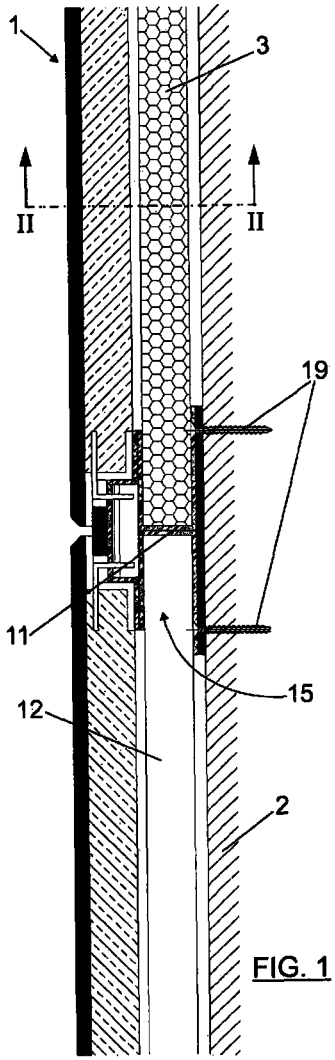
FIG. 1 shows a horizontal sectional view, taken according to the cutting line I-I of FIG. 2, of a cladding built according to the invention and applied on an already-existing drywall.
Figure 2:
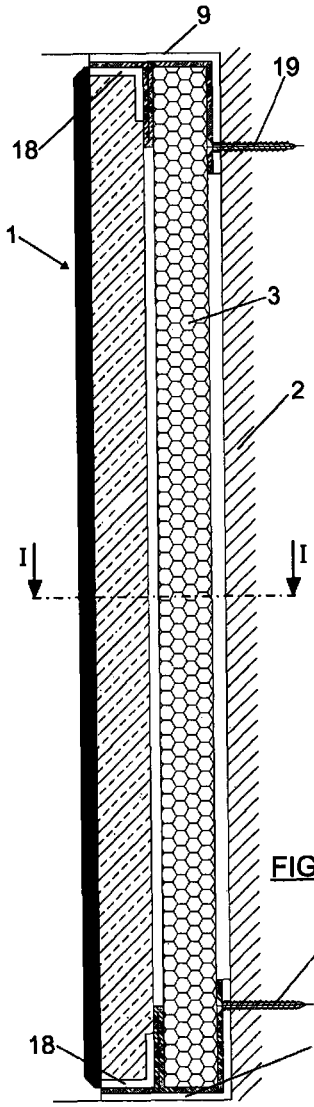
FIG. 2 shows a horizontal sectional view of the same cladding, taken according to the cutting line II-II of FIG. 1.
Figure 3:
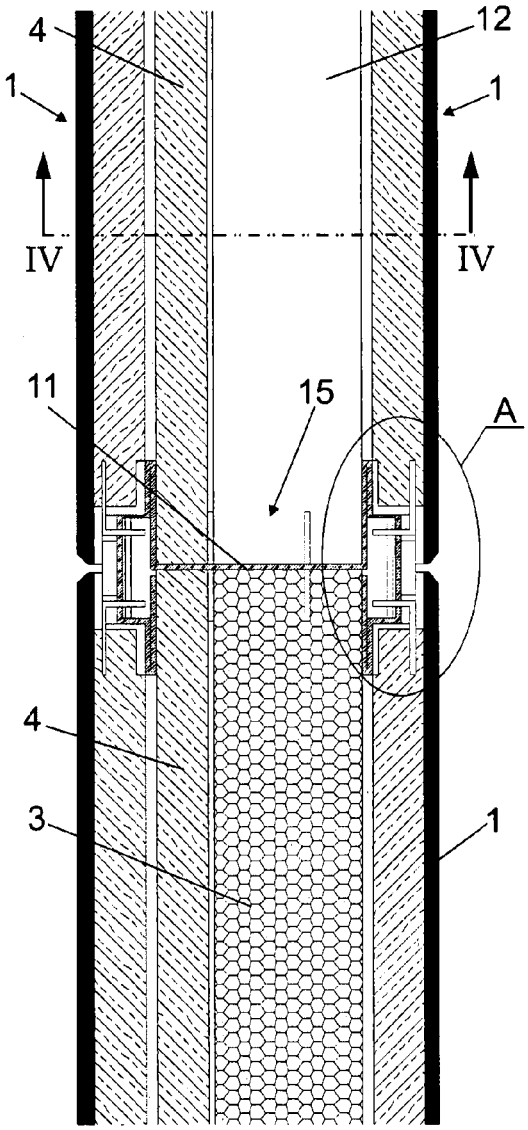
FIG. 3 shows a horizontal sectional view of the a drywall built according to the invention, taken according to the cutting line III-III of FIG. 4, with constructive elements installed on both sides of the load-bearing structure.
Figure 4:
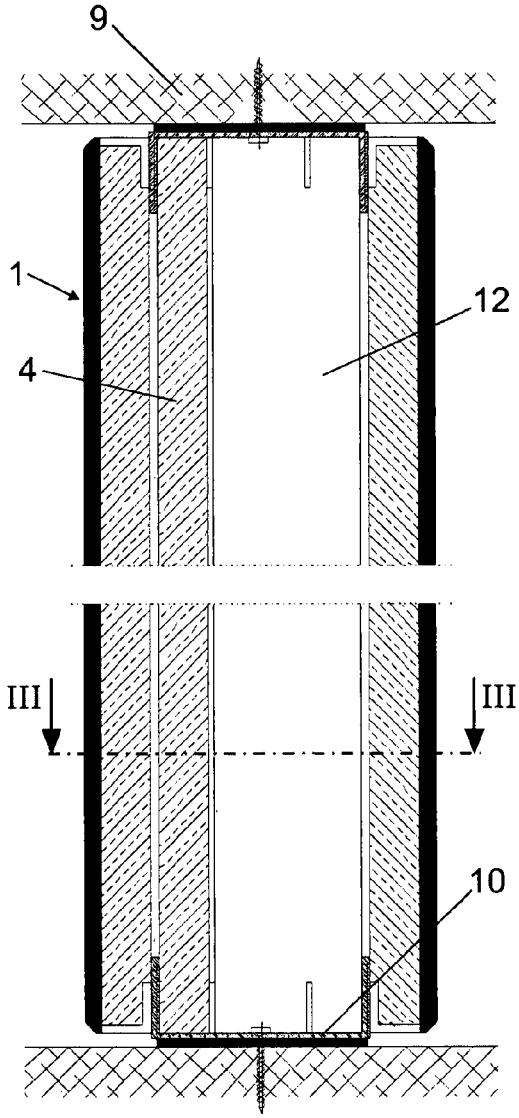
FIG. 4 shows a vertical sectional view of the same drywall, taken according to the cutting line IV-IV of FIG. 3.
Figure 5:
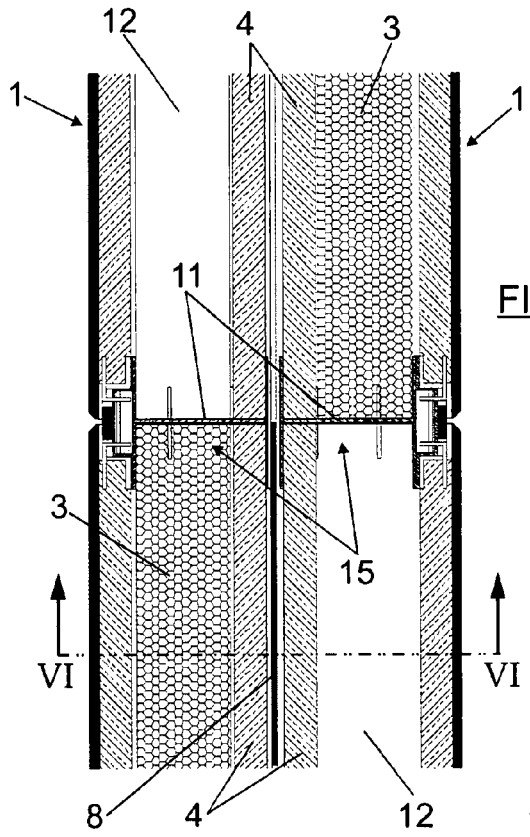
FIG. 5 shows a horizontal sectional view of a drywall built according to the invention, with double structure, taken according to the cutting line V-V of FIG. 6.
Figure 6:
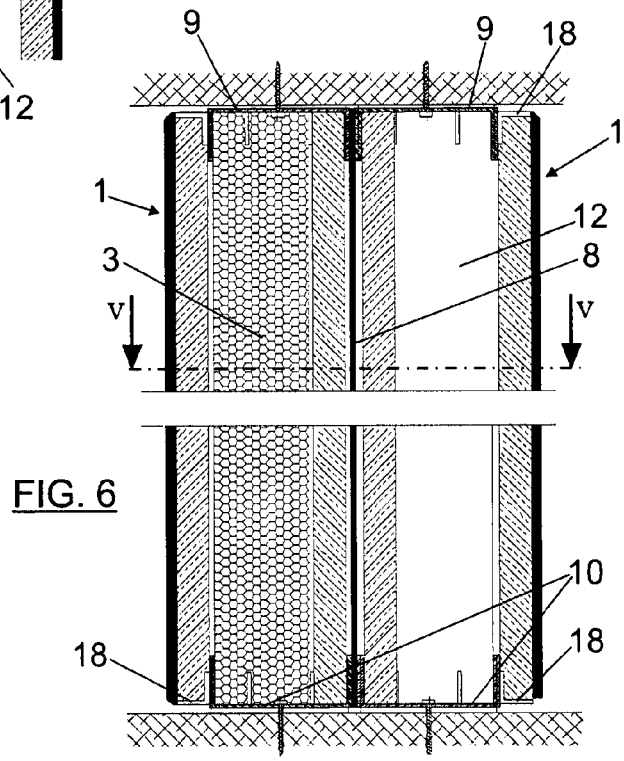
FIG. 6 shows a vertical sectional view of the same drywall, taken according to the cutting line VI-VI of FIG. 5.

With the essential characteristics of the invention, it is possible to configure different types of drywalls and applications with the advantages shown in the present memory and which are described according to the aforementioned set of drawings:

The load-bearing structure represented in FIGS. 1-6 indicated in the present invention comprises vertical profiles (11) as well as a floor profile (10) and a roof profile (9), both metallic, these two guides (9) and (10) can form part of the load-bearing structure itself as it can be seen in FIGS. 4 and 6, or they can be incorporated as independent parts to a pre-existing drywall (2) which constitutes the load-bearing structure in this case, as it can be seen in FIG. 2.

The construction systems represented in FIGS. 1-6 comprise, besides the aforementioned load-bearing structure, constructive elements (1) which are anchored to the vertical profiles (11), which form the load-bearing structure in the case of the examples represented in FIGS. 3 to 5 or they are fixed to a pre-existing drywall (2) in the case of FIG. 1.

FIG. 1 represents a cladding construction system with an additional insulating layer (3), or it could also be a functional layer, in one of its areas and with a hollow area (12) for the air chamber or the passage of installations in another area and in which the load-bearing structure is an existing drywall (2). The fixing of the cladding comprises screws (19) which assemble the vertical profiles (11) held by the insulating layer (3) and the constructive elements (1) to the drywall (2) which constitutes the load-bearing structure.

FIG. 2 shows the drywall (2) which constitutes the construction system represented in FIG. 1, in which the insulating layer (3) is incorporated as an additional layer between the constructive element (1) and the pre-existing drywall (2) which acts as a load-bearing structure.

FIGS. 3 and 4 represent a standard construction system of the invention comprising constructive elements (1) joined by both faces to a load-bearing structure comprising vertical profiles (11) and roof (9) and floor profiles (10), with an installation support layer (4) and with a hollow area (12) following for the air chamber or passage of installations in an area and an insulating layer (3), which can also be a functional layer, in another area. FIG. 4 shows a vertical profile of one of the areas of the drywall shown in FIG. 3, in which the roof (9) and floor profiles (10) can be seen.

FIG. 5 represents a construction system with double structure, used for the construction of a drywall in which, due to functional needs for greater sound insulation (separating two adjacent hotel rooms) or for safety reasons (in the case of a partition between two houses), there are incorporated two independent and consecutive load-bearing structures, so that a double support layer (4) is incorporated for the passage of installations, where it is also possible to incorporate a safety sheet (8) between both construction systems, as it can be seen in the areas represented in FIG. 5. The drywalls are closed in the same way as in the case of the drywalls represented in FIG. 3, but instead of closing them with a constructive element at the opposite end, they are closed with a second construction system with similar characteristics as the one being coupled thereto, thus constituting the so-called double construction system.

FIG. 6 shows a section of FIG. 5 of the area comprising a safety sheet (8), showing an elevation view of the double drywall with the aforementioned characteristics, with an insulating layer (3) in one of its sides and a hollow area for the air chamber or for the passage of installations (13) in the opposite side.

If it is necessary to increase the functional characteristics (sound insulation, thermal insulation, fire protection, waterproofing) of a drywall, it is possible to incorporate additional functional plates (rock wool, glass wool, aluminium sheets, etc.) which are included in the hole (12) between the installation support plate (4) and the drywall closure constructive element (1).

As it can be seen in FIGS. 7 and 8, the anchoring pieces are constituted by an omega-shaped fixed constructive (20) which is fixed to the vertical constructive (11) of the load-bearing structure through its wings and houses a U-shaped sliding profiles (14) inside it, having such dimensions that it can slid along the omega-shaped fixed profile (20).

The omega-shaped fixed profile (20), FIGS. 7 and 9, has holes (7) which constitute female anchoring pieces.

The sliding profile (14), which can slid inside the fixed profile (20), has openings (5) which, as it can be seen better in FIG. 9, have two contours with different widths, consecutively located in the movement direction of the fixed profile (14), a first wider contour (21) and a second narrower contour (22). In the example shown in FIG. 9, the two contours have longitudinally straight contours and are joined by an intermediate section (23) with variable width. The second narrower contour (22) could be in a centred position, with respect to the first wider contour (21). In any case, the two contours can be selectively opposite the holes (7), by means of the longitudinal movement of the sliding profile (14) in an upward or downward direction.

The fixed profile (20) fixed to the load-bearing structure (11) and the sliding profile (14) constitute the anchoring means.

As for the joining pieces of the constructive elements (1), they are constituted by male elements (6), FIG. 8, fixed to the constructive elements, whose number and position coincide with the openings (7) of the fixed profiles (20).

In the mounting of constructive elements, the male elements (6), which constitute the joining pieces of the constructive elements (1), will be inserted through the holes (7) and the wider contour (21) of the openings (5), opposite said holes (7). Next, the sliding profile (14) will be moved downwardly, so that the male elements (6) are inserted through the narrower contour (22) of the openings (5), to be retained by the sliding profile (14), through formations of male elements (6), as it will be indicated below.

As it can be seen in FIGS. 7 and 9, the fixed profile (20) can have two rows of holes (7), while the sliding profile (14) will have two rows of openings (5), for the fixing of adjacent panels, as it can be seen in FIG. 8.

In order to improve the junction, a rubber seal (17) can be incorporated, FIG. 8, thus attaining the water tightness and coupling to the load-bearing structure, being possible to also insert a decorative platten (16) which maintains the homogeneity of the construction system.

Figure 10:
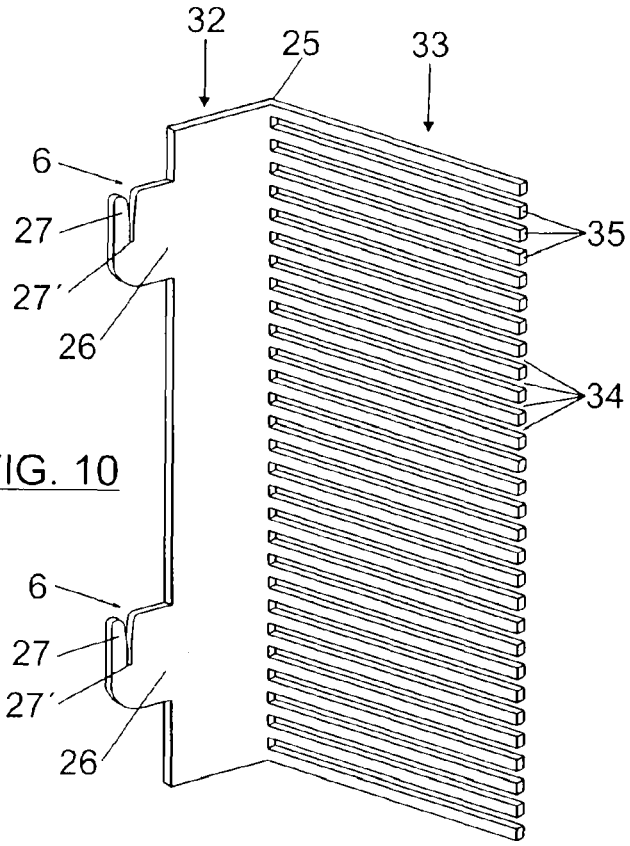
FIG. 10 shows a perspective view of the platten constituting the joining pieces of the cladding of FIG. 8.
Figure 11:
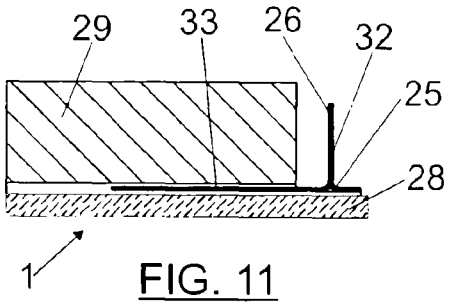
FIG. 11 is a partial sectional view of a constructive element, with the joining pieces of FIG. 10 incorporated.

The joining pieces of the constructive elements can be constituted, as shown in FIG. 10, by a platten (25) which can include a longitudinal crease which determines two portions, a first portion (33) in contact with the constructive elements and through which it is fixed in said constructive elements, as it can be seen in FIG. 11, and a second portion (32) from which there protrude the male elements (6), constituted by coplanar tongues (26) which form upwardly open hooks (27). The number and separation of these tongues (26) will coincide with the openings (5) of the sliding profiles (14) and the holes (7) of the fixed profiles (20).

The platten (25) is fixed to the constructive elements (1) in a direction parallel to the fixed profiles (20) and sliding profiles (14) of the anchoring pieces through the first portion (33). For example, as shown in FIG. 11, the platten (25) can be closed in the constructive elements (1), at least along the free edge of the first portion (33). In the example shown in FIG. 11, the constructive elements (1) comprise an external plate (28) with reduced thickness, preferably ceramic, and an internal plate (29) with a greater thickness which adds structural and bearing strength to the constructive element (1), being both layers joined by an intermediate layer (30), comprising for example an adhesive substance. With this constitution, the first portion (33) of the platten (25) can be inserted, in the already described manner, between the layers (28 and 29).

The platten 25 can have two transverse creases at 90° in the same or different direction. In the latter case, it forms a Z-shaped section (31), as shown in FIG. 12, with a second end portion (32), the tongues (26) forming the hooks (27) protruding, and a first end portion (33), through which this Z-shaped flat stock will be fixed in the constructive element, as shown in FIG. 13.

The platten (25) of FIG. 10 can have in a first portion (33) and from its free edge indentations or transverse cuts (34) which determine coplanar teeth (35). The indentations or transverse cuts (34) will be as long as the width of the first portion (33) of the platten (25) which is in contact with the constructive element (1).

Figure 12:
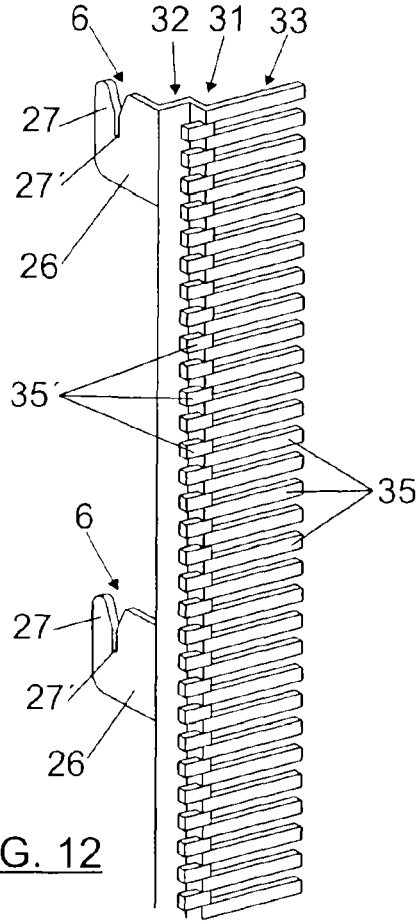
FIG. 12 shows an embodiment variant of the joining pieces of the constructive elements.
Figure 13:
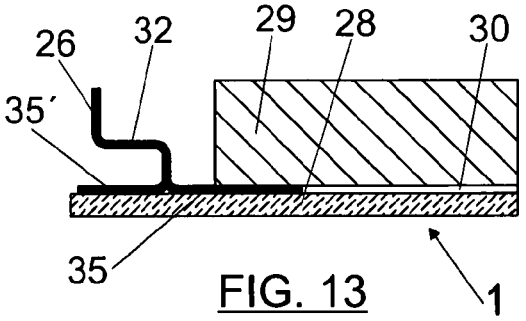
FIG. 13 shows a similar sectional view to FIG. 11, with the joining pieces of FIG. 12.

In the embodiment example of FIG. 12, the Z-shaped first portion (33) also has indentations or transverse cuts (34) which determine coplanar teeth (35 and 35'), which can be oriented in opposite directions, in order to provide a greater contact surface with the constructive elements (1), as shown in FIG. 13, being the teeth (35) intended to be inserted between the plates (28 and 29) of the constructive element, as in the case of FIG. 11, while the teeth (35') rest only on the plate (28).

In any case, the indentations or transverse cuts (34) will allow the constructive element (1), with the corresponding joining pieces, to be cut in a direction perpendicular to said joining pieces with a cutting tool, such as a cutter, since on the joining pieces the cut can be performed through one of the indentations (34). This possibility makes it unnecessary to use electrical cutting tools, for example, a circular saw, in order to perform the cut of the constructive elements in any direction.

Figure 14:
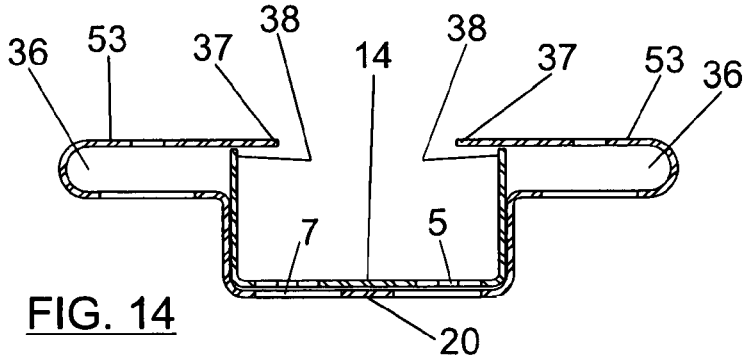
FIGS. 14 to 16 show similar sectional views of FIG. 7, showing other embodiments variants of the anchoring pieces of the cladding.
Figure 15:
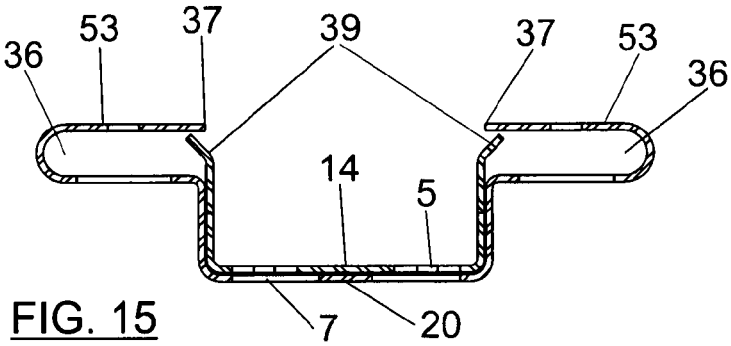
Figure 16:
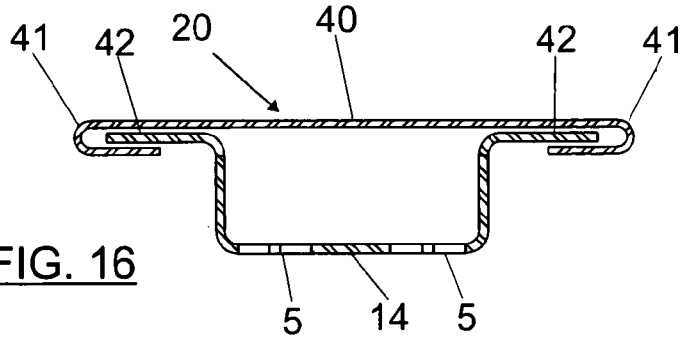

FIGS. 14 to 16 show embodiment variants of the anchoring pieces shown in FIG. 8. In FIG. 14, the end branches of the omega-shaped fixed profiles (20) are folded inwards over themselves in a 180° angle, forming opposite channels (36), being the free longitudinal edge (37) of the external walls of these channels separated at a distance smaller than the free edge (38) of the walls of the sliding profiles (14), so that said sliding profile (14) cannot be accidentally released from the fixed profile (20). The embodiment shown in FIG. 15 is similar to that of FIG. 14, except in that the walls of the sliding profile (14) end in divergent end sections (39), whose longitudinal edges are separated at a greater distance than the edges (37) of the channels (36), to define together retention pieces of the sliding profiles (14) inside the fixed profiles (20).

Figure 17:
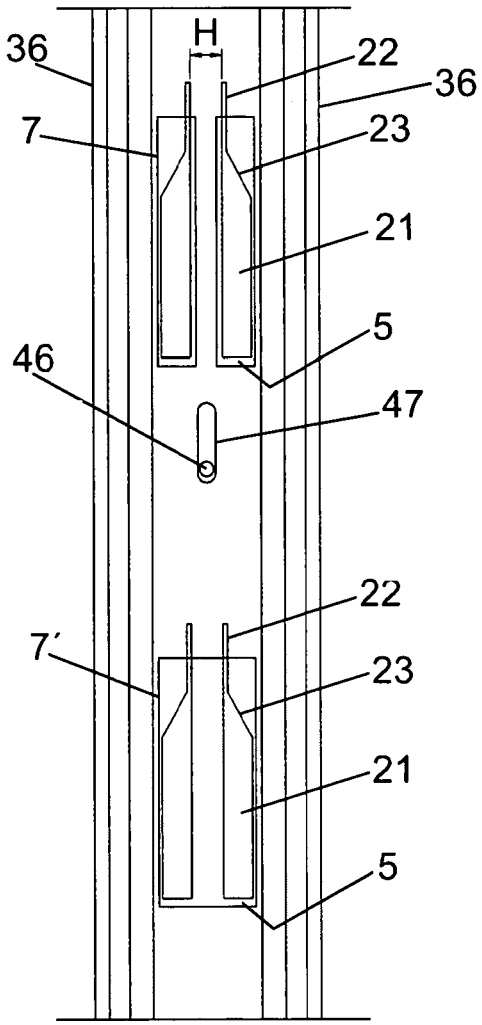
FIG. 17 shows an elevated frontal view of the joining pieces of FIGS. 14 and 15.

FIG. 17 shows a frontal elevation view of the set of sliding profile (14) and fixed profile (20) of FIGS. 14 and 15 of the anchoring pieces, showing the holes (7) of the fixed profiles (20) and the openings (5) of the sliding profiles (14), with their edges (21 and 22) with greater and smaller width, respectively.

Figure 18:
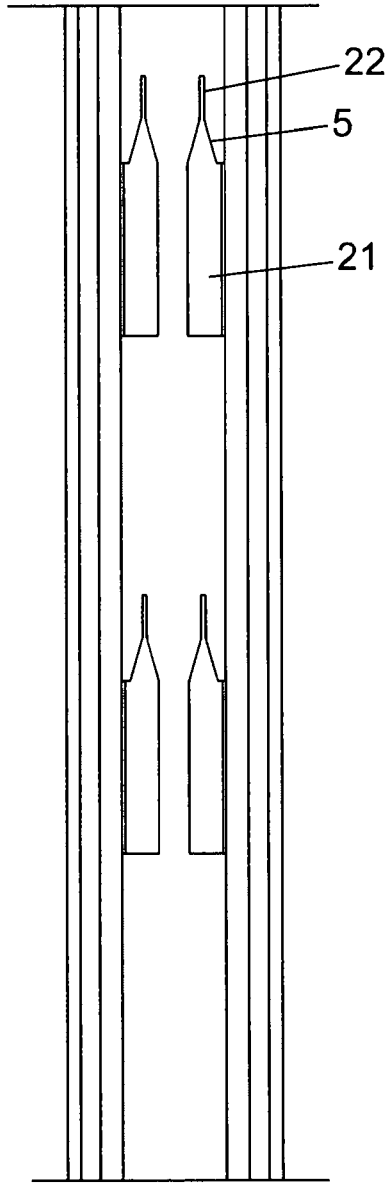
FIG. 18 shows an elevated frontal view of the joining pieces of FIG. 16.

In the embodiment shown in FIG. 16, the fixed profile (20) has a flat web (40) which ends longitudinally in opposite channels (41), while the sliding profile (14) has an omega shape, whose end branches (42) are housed in the channels (41), and can move along them. In this embodiment, as it can be seen in the frontal elevation view of FIG. 18, the fixed profile (20) has no holes, only the sliding profile (14) having openings (5), with their two contours (21 and 22) having a greater and smaller width, respectively.

As shown in FIGS. 9 and 17, the openings (5) of the sliding profiles (14) and the holes (7) of the fixed profiles are made in pairs, in the web of said sections, the two openings and holes of each pair being located at the same height in the corresponding section and also with the openings and holes of both pairs being aligned along the corresponding sliding and fixed sections.

Figure 19:
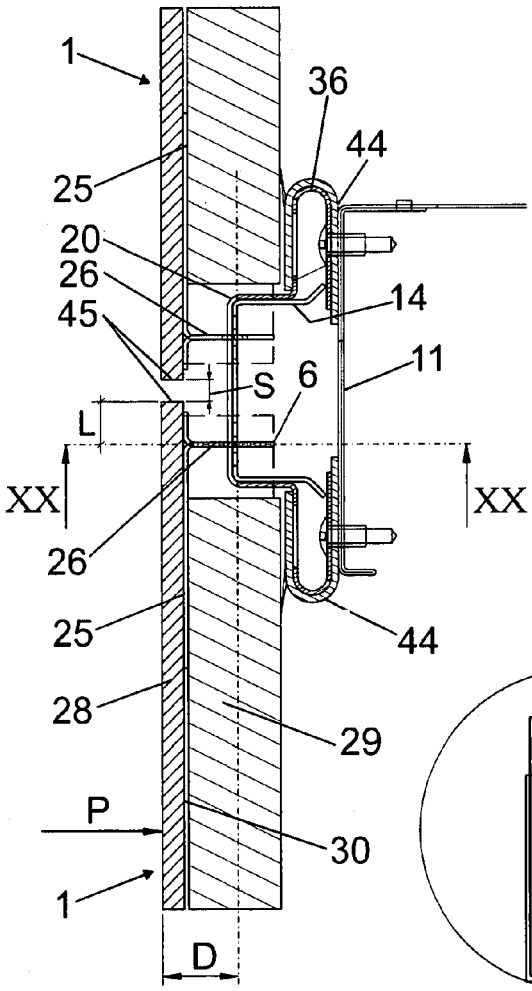
FIG. 19 shows a horizontal sectional view of a cladding fixed to the load-bearing structure, according to the invention, with the anchoring pieces of FIG. 14.

As the sliding profiles (14) have pairs of openings (7), located at the same height, they make it possible to receive the tongues or male elements (6) of two consecutive constructive elements, as shown in FIGS. 9 and 19. Adjusting the separation of the two openings (7) of each pair of openings located at the same height, different separations between consecutive constructive elements can be attained, with parallel edges (45) thereof, condition which is guaranteed also due to the fact that the narrower contour (22) of the openings (5) of the sliding profiles is as wide as the thickness of the tongues (26) which form the hooks (27) of the joining pieces, thus securing the separation (S) and parallelism between the adjacent edges (45) of the consecutive constructive elements (1), as shown in FIG. 19.

The male elements (6) can have a different configuration to the one shown in FIGS. 10 and 12, having in any case formations capable of being inserted through the first narrower contour (21) of the openings (5) and retained by the narrower contour (22) of said openings, where in any case the male elements can be accessed from the rear face of the constructive elements.

Figure 21:
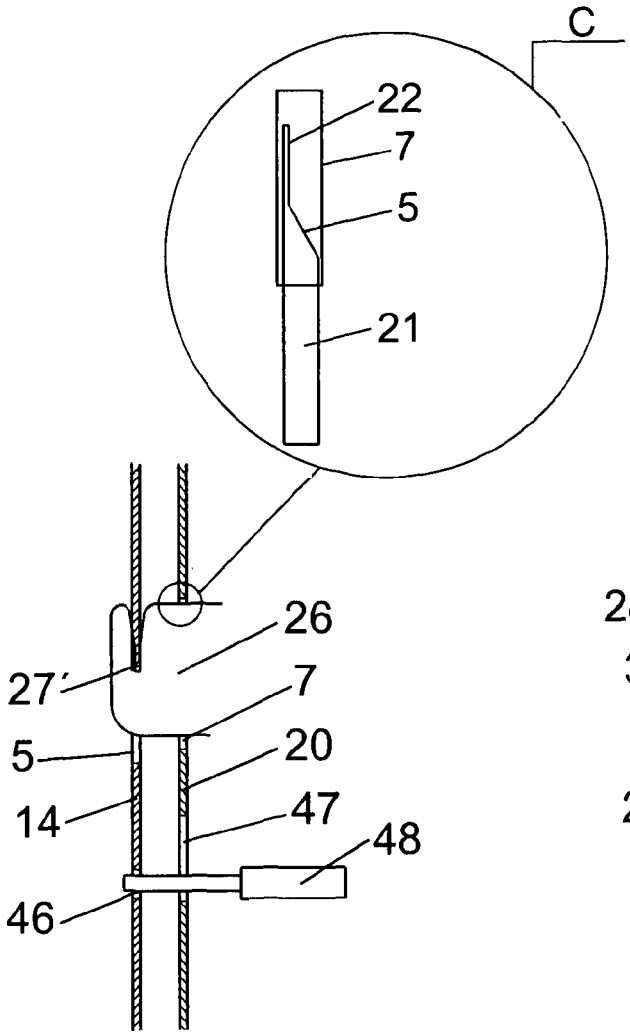
FIG. 21 shows a similar sectional view to FIG. 20, with the joining pieces of the constructive elements fixed to the anchoring pieces.

The evenness between the outer surfaces of all constructive elements of a cladding is attained thanks to the positioning of the formations of the male elements with respect to the outer visible surface of said constructive elements, as it will be indicated with reference to FIGS. 19 and 21.

FIG. 19 shows a partial horizontal sectional view of a similar cladding to the one in FIG. 8, where there appear two consecutive elements, having male elements (6) and which are fixed to the profiles (11) of the load-bearing structure through anchoring pieces as the ones shown in FIG. 15, comprising a fixed profile (20) and a sliding profile (14). Around the channels (36) of the fixed profile (20) there can be rubber seals (44) on the outer side.

The male elements (6), which constitute the joining pieces of the constructive elements (1), can have a hook configuration, similar to the one described with reference to FIGS. 10 and 12, where the bottom (27') of the hook which constitutes the configuration of the male element is located at a constant distance (D) from the plane (P), said plane being defined by the outer visible surface of the front plate (28) of the constructive elements, and at a constant distance (L) from the plane of the adjacent longitudinal edge (45) of the constructive element, FIG. 22. With this constant distance (D) it is attained the coplanarity of the outer visible surface (P) of all constructive elements of a cladding, from the correct positioning of the load-bearing structure, shown in FIG. 19 in sections (11).

Figure 20:
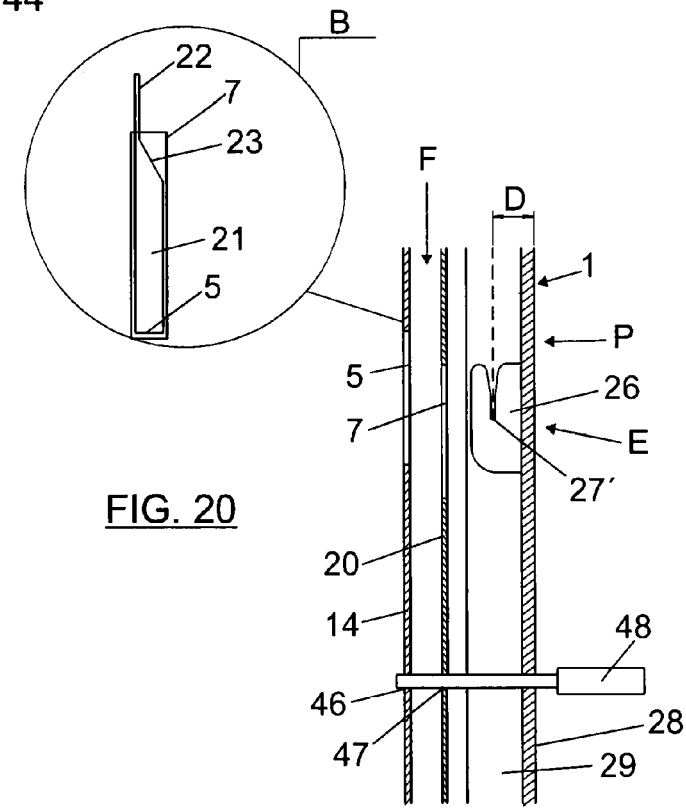
FIG. 20 shows a schematic sectional view of the cladding, before fixing the joining pieces of the constructive elements to the anchoring pieces, taken according to the cutting line XX-XX of FIG. 19.

FIG. 20 shows the same distance (D) between the plane (P) and the bottom (27') of the hook-shaped configuration (27) of the male element (6) of the constructive elements.

The adjacent edges (45) of the consecutive constructive elements (1), FIG. 19, will be parallel and separated at a predetermined distance which is defined by the distance (H), FIG. 17, between the centres of the narrower contours (22) of each pair of openings (5) of the sliding profiles (14). In order to attain the maximum accuracy in this separation, the tongues (26) forming the hooks (27) of the male elements (6), FIGS. 10 and 12, will be as thick as the width of the narrower contours (22) of the openings (5) of the sliding profiles (14).

FIG. 8 shows the distance (S) between adjacent edges (45) of consecutive constructive elements (1), the distance (L) between the male elements (6) and the plane of the adjacent edge (45) of the constructive element and the distance (H) between male elements (6) fixed through the intermediate anchoring pieces and belonging to consecutive constructive elements (1).

As shown in FIGS. 20 and 21, the sliding profiles (14) can be displaced between an inactive position, FIG. 20, and a retention position, FIG. 21, of the male element, constituted by the hook (27).

In the inactive position, shown in FIG. 20, the wider contour (21) of the openings (5) of the sliding profiles (14) faces the holes (7) of the fixed profiles (20), as shown in detail (B) in FIG. 20. In this situation, the male elements of the constructive elements, constituted by the tongues (26) forming the hooks (27), can freely penetrate through said holes (7) and openings (5), moving the constructive elements in the direction (E) of FIG. 20. Once the tongues (26) have been inserted in the manner described, the sliding profile (14) is moved downwardly as shown by the arrow F of FIG. 20, so that the narrower contour (22) of the openings (5) occupies the position shown in the detail (C) of FIG. 21, where it surrounds and rests by the upper edge of said contour (22) on the bottom (27') of the hook (27), as shown in FIG. 21, thus being the hook blocked without any possibility of being separated from the anchoring pieces defined by the sliding profiles (14) and fixed profiles (20).

In order to attain the movement of the sliding profiles in the manner described, these sliding profiles will have in their web, between consecutive openings (5), a first slit (46) which is accessible through a second larger slit (47) of the fixed profiles (20) in the opposite position. In the embodiment of FIG. 16, the fixed profiles (20) will lack both the openings (7) and the second slits (47).

Through the second slits (47) a tool (48) or alike is inserted until it penetrates through the first slit (46). Propelling the tool (48) downwardly, it is possible to propel the aliding profile (14) from the inactive position of FIG. 20 to the retention position of FIG. 21.

The tool (48) can be inserted between adjacent edges (45), FIG. 19, of consecutive constructive elements (1).

Figure 22:
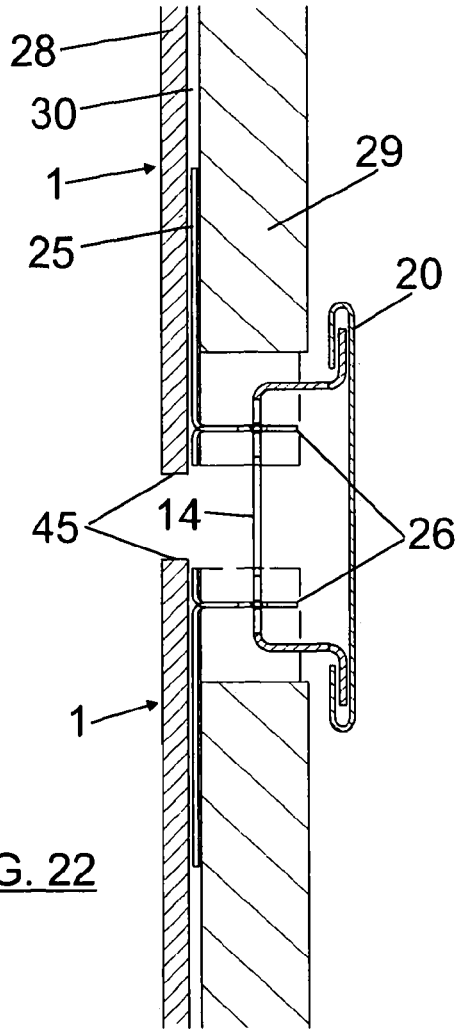
FIG. 22 shows a similar view to FIG. 19, with the anchoring pieces of FIG. 16.

FIG. 22 shows a similar embodiment to FIG. 19, but with the anchoring pieces shown in FIG. 16, using the same references as in these figures to indicate coinciding elements or parts.

In the embodiment shown in FIG. 22, the fixed profile (20) is located behind the mobile profile (14), so that the openings (5) of this sliding profile are directly accessible through the separation between the adjacent edges (45) of consecutive panels (1), where the fixed profiles (20) do not have the holes (7).

Figure 23:
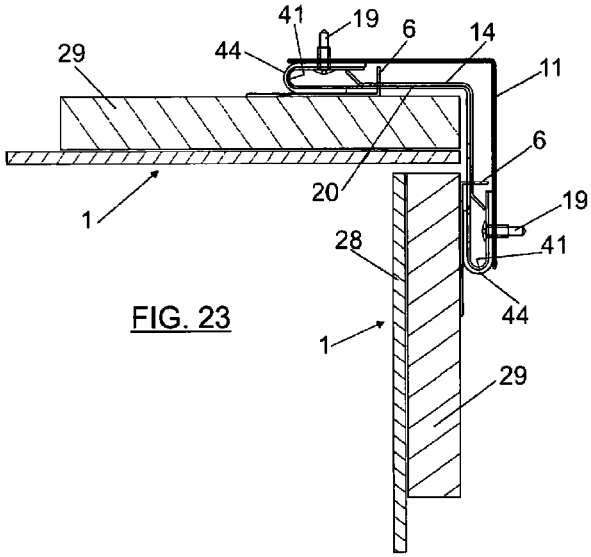
FIG. 23 shows a similar sectional view to FIG. 19, of a cladding in an outer corner.
Figure 24:
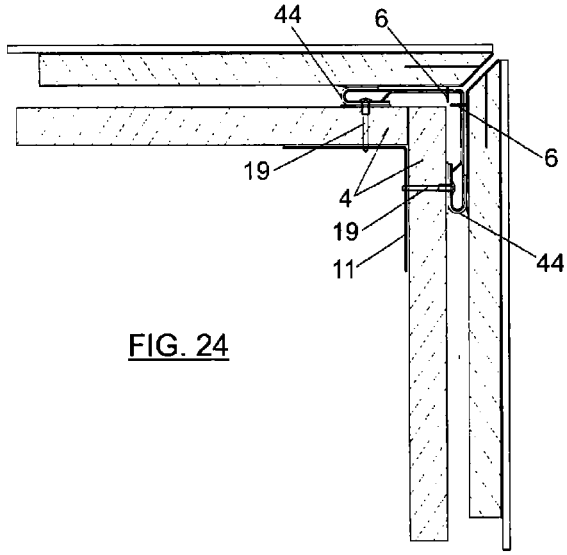
FIG. 24 shows a similar sectional view to FIG. 23, of a cladding in an inner angle.
Figure 25:
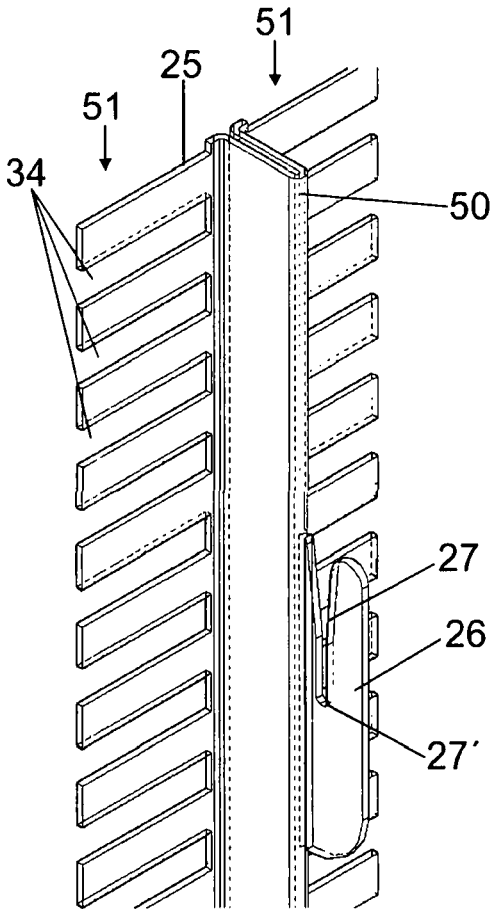
FIGS. 25 to 26 show similar views of FIG. 12, showing other embodiment variants of the joining pieces of the constructive elements.

FIG. 23 and FIG. 24 show potential variants of the anchoring pieces for mounting the constructive elements (1) in corners.

In FIG. 23, the anchoring pieces are arranged exteriorly in the angle formed by two constructive elements, while in FIG. 24 they are arranged inside said angle. In both cases, the anchoring pieces can correspond to a similar structure to that of FIG. 16, in which both the fixed profile (20) and the sliding profile (14) are folded outwards through their web in a right angle, which corresponds to that of the corner formed by the constructive elements (1).

In the case of FIG. 4, the joining pieces of the constructive elements, which include the male elements (6), are fixed to the outer face of the rear layer (29) of the constructive elements. Through the outer wall of the channels (41), similar to those of FIG. 16, the fixed profiles (20) are fixed to the sections (11) of the load-bearing structure.

In the case of FIG. 24, the anchoring pieces also have a similar structure to the one shown in FIG. 16, but with the crease of the sliding profiles (14) and fixed profiles (20) in opposite direction, with respect to the structure of the anchoring pieces of FIG. 23. Also, the fixing of the constructive elements to the sections (11) of the load-bearing structure is performed in the same way, with the interposition of layers (4) which can be made of insulating material.

Figure 26:
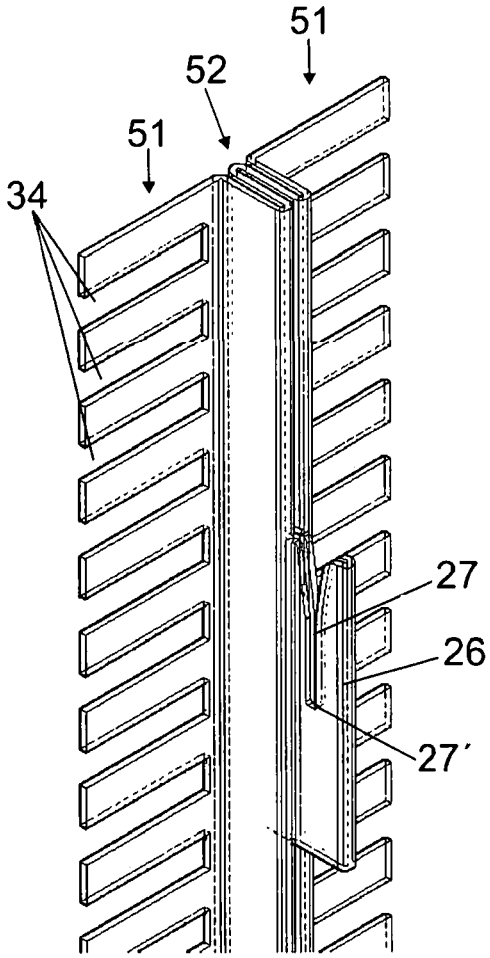
Figure 27:
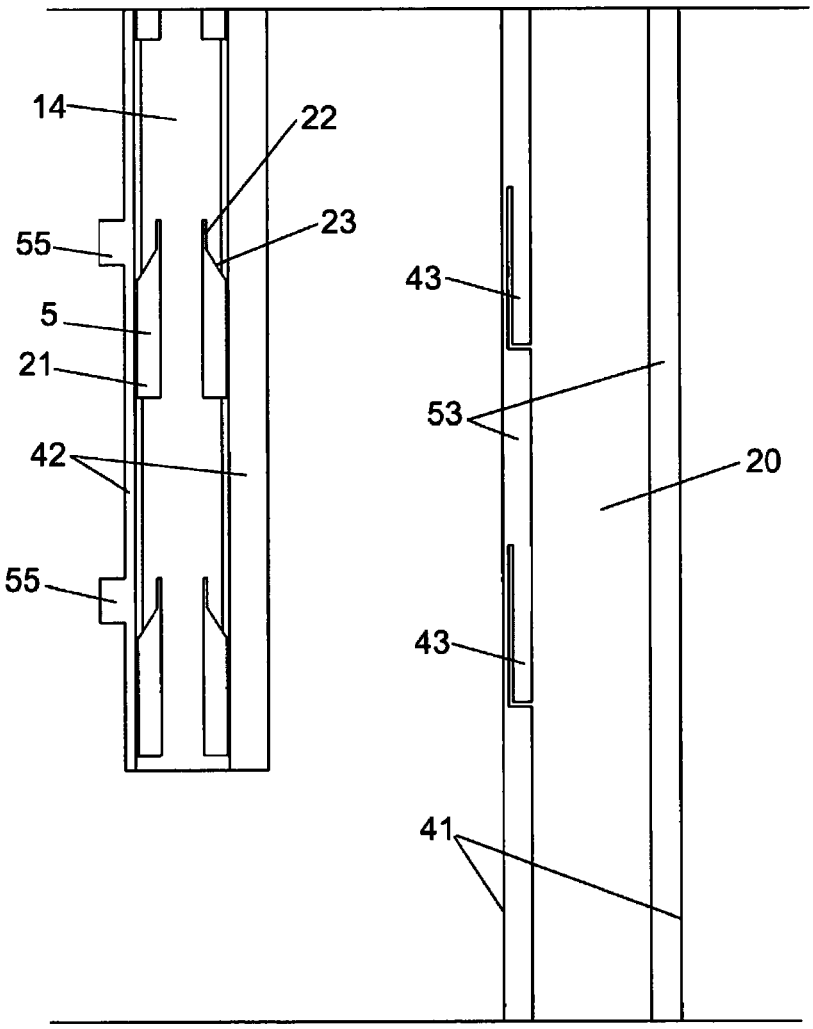
FIG. 27 shows a frontal elevation view of a possible embodiment of the anchoring pieces.

FIGS. 26 and 27 show variants of the flat stocks which form the joining means of the construction elements, with respect to the ones shown in FIGS. 10 and 12.

In the case of FIG. 26, the flat stock (25) has a longitudinal crease at 180°, defining an intermediate fold (50) with flanges (51) at each side for its fixing to the constructive element. From the intermediate fold (50) there protrude the tongues (26) which form the hooks (27). The flanges (51) have slits (34), with the same characteristics as the ones described with reference to FIG. 10. The flanges (51) constitute the first portions (33) which are in contact with the constructive elements, while the central fold (50) constitutes the second portion (32) from which the tongues (26) protrude.

In the case of FIG. 27, the platten (25) has a series of consecutive folds, determining an accordion-shaped intermediate configuration (52), at both sides of which the flanges (51) are located with the transverse recesses (34), protruding from one of the folds the tongues (26) which form the hooks (27).

FIGS. 10, 12, 26 and 27 give an idea of the diversity of forms the joining pieces of the constructive elements can have, always having male elements which in the examples described are constituted by the tongues (26) forming the hooks (27). Regardless of the configuration of the platten (25), it will always be arranged in a parallel direction to the sliding profile (14) and the fixed profiles (20) of the anchoring pieces. Also, the position and number of tongues (26) of the plattens (25) will coincide with the position and number of openings (5) of the sliding profiles (14) and holes (7) of the fixed profiles (20).

As shown in FIG. 17, each pair of windows (7) located at the same height can be replaced by one window (7'), with such dimensions that it grants access to the openings (5) of the sliding profile (14).

Figure 28:
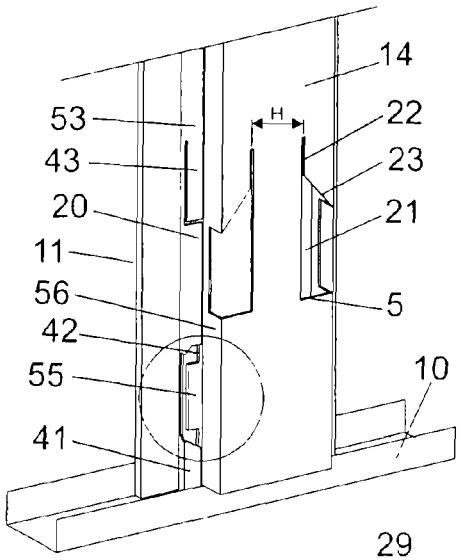
FIG. 28 shows a perspective partial view of the mounting system of the anchoring pieces of FIG. 27.

As shown in FIGS. 27 and 28 and in order to facilitate the mounting of the sliding profile (14) in the fixed profile (20) of the anchoring pieces shown in FIG. 16, the external flanges (53) of one of the opposite channels (41) of the fixed profile (20) has, from the free edge, L-shaped cuts which determine flexible longitudinal pins (43). As for the sliding profiles (14), they have, at least in one of their end flanges (42), flat tabs (55), whose number and separation coincide with the longitudinal pins (43). With this constitution, as shown in FIG. 28, the end flange (42) of the sliding profile (14) lacking the tabs (55) is inserted in the corresponding channel (41) of the fixed profile (20), the tabs (55) of the opposite end flange of the sliding profile resting on the longitudinal pins (43), pressing said tabs (55) towards the inside of the fixed profile (20), until attaining the bending of the pins (43), allowing the insertion of said tabs (55) in the channel (41) of the fixed profile (20), through the displacement of the sliding profile (14) until the tabs (55) go beyond the free end of the pins (43).

On the other hand, in order to facilitate the mounting of the constructive elements, for example with the same anchoring pieces shown in FIGS. 27 and 28, the wider contour (21) of the openings (5) could be partially extended over the lateral flanges (56) of the sliding profile (14), thus facilitating both the lateral and frontal insertion of the tongues (26) in the openings (5).

Figure 29:
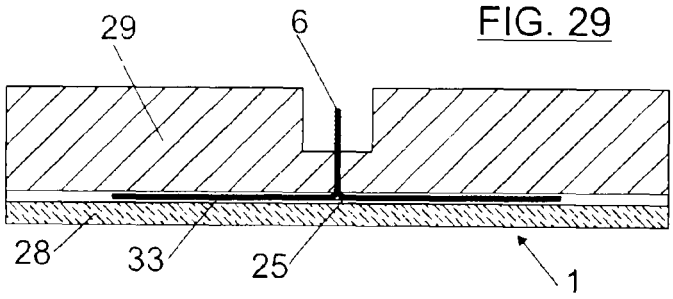
FIG. 29 shows a partial sectional view of a constructive element with an intermediate joining element.

The platten (25) which constitute the joining pieces of the constructive elements can also be fixed to said elements along intermediate areas, not coinciding with the edges of said constructive elements, as shown in FIG. 29. The tool (48) access to the first slit (46), FIGS. 20 and 21, would be through holes drilled in the constructive elements (1) themselves.

Figure 30:
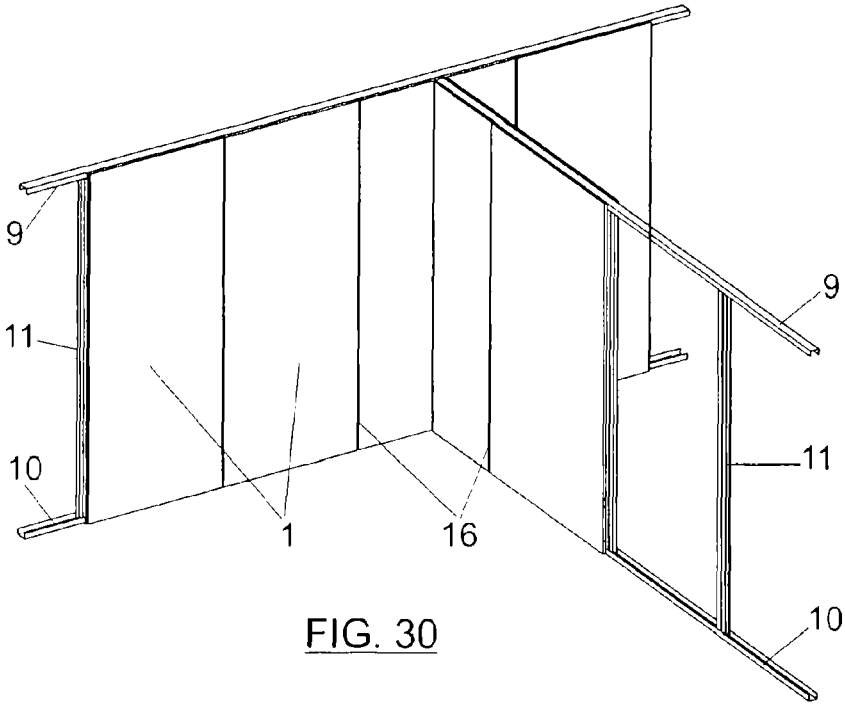
FIG. 30 shows a perspective schematic view of a cladding built according to the invention.

Finally, FIG. 30 shows a cladding in angle built according to the invention, in which the load-bearing structure would be constituted, as in the case of FIGS. 1 to 6, by a roof guide section (9), a floor guide section (10) and vertical profiles (11), where the vertical profiles (11) can define or serve as fixed profiles (20) of the anchoring pieces.

As in the case of FIG. 8, the separation between the consecutive constructive elements (1) can be closed by a decorative platten (25).

The invention claimed is:

1. Drywall construction system, comprising:

a load-bearing structure, and large-surface flat construction elements which have joining pieces, and anchoring pieces fixing the joining pieces of the construction elements to the load-bearing structure;

wherein the anchoring pieces comprise:

fixed profiles which have female elements forming holes, said fixed profiles are fixed to the load-bearing structure, and sliding profiles equal in number to the fixed profiles, each one of the sliding profiles being longitudinally mounted on one of the fixed profiles such that the sliding profile is movable along the fixed profile and provided with openings, the openings coinciding in number and position with the holes of the fixed profiles, each one of the openings has two contours with different widths, the two contours being consecutively located in a movement direction of the sliding profiles; and wherein the joining pieces of the construction elements have male elements, the male elements coinciding in number and separation with the openings of the sliding profiles and holes of the fixed profiles, the male elements have formations which can be inserted through a wider contour of the openings and retained by a narrower contour of the openings, said male elements being accessible through a rear of the construction elements for insertion through said openings and through windows; and wherein the sliding profiles can be longitudinally slid with respect to the fixed profiles between an inactive position, in which the wider contour of the openings of the sliding profiles faces the holes of the fixed profiles, allowing passage of the male elements of the joining pieces of the construction elements through said openings and holes, and a retention position, in which the narrower contour of the openings faces the holes and covers over the formations of the male elements preventing release of said formations.

2. The system according to claim 1, wherein the narrower contour and the wider contour of the openings of the sliding profiles are joined by an intermediate section, with variable width, acting as a connection between said contours.

3. The system according to claim 1, wherein the joining pieces of the construction elements comprise at least one platten which has a portion fixed to the construction elements in a direction parallel to a front plane of said construction elements, and which has the male elements.

4. The system according to claim 1, wherein the fixed profiles are rectangular, omega-shaped and are fixed through flanges to the load-bearing structure.

5. The system according to claim 1, wherein the sliding profiles have a rectangular U shape, with external dimensions slightly smaller than internal dimensions of the fixed profiles, and the sliding profiles have the openings in a web, and each one of the sliding profiles is mounted inside one of the fixed profiles, with the opening of the sliding profile oriented in the same direction as the hole of one of said fixed profiles.

6. The system according to claim 4, wherein the flanges of the fixed profiles are folded inwards over themselves 180°, comprising two opposite channels having outer walls fixed to the load-bearing structure.

7. The system according to claim 6, wherein free edges of side walls of the sliding profiles are separated from each other a distance greater than a separation distance of free edges of the outer walls of the channels of the fixed profiles, said outer walls defining retaining pieces of the sliding profiles inside the fixed profiles.

8. The system according to claim 1, wherein the male elements of the joining pieces comprise coplanar tongues in the form of hooks, which protrude from one of the longitudinal edges, oriented in the same direction, and which can be inserted through the holes of the fixed profiles and openings of the sliding profiles, in the inactive position of said sliding profiles, to receive an adjusted coupling of the narrower contour of said openings, when the sliding profile is moved towards a retention position, located at a bottom of the hook, said bottom being located at a fixed distance with respect to an outer visible surface of the construction element to secure the coplanarity of the outer visible surface of all construction elements and at a distance, also fixed, from a longitudinal edge plane closest to the construction element.

9. The system according to claim 8, wherein the platten has indentations which are perpendicular to the movement direction of the sliding profile of the anchoring pieces, which are as long as the width of a portion of said platten in contact with the construction element, said indentations having coplanar teeth.

10. The system according to claim 9, wherein the portion of the platten in contact with the construction elements is closed at least partially in the construction elements, at the edge opposite an edge occupied by the coplanar teeth, at least in one of an edges of said construction elements.

11. The system according to claim 8, wherein the platten which forms the joining means has creases at 90°, according to the direction of the movement of the sliding profile of the anchoring pieces, which determine two end portions, a first end portion, which is fixed to the construction elements, and a second end portion, from which the coplanar teeth protrude.

12. The system according to claim 1, wherein the openings of the sliding profiles and the holes of the fixed profiles are drilled in pairs, the two openings and the two holes of each pair being located at a same height and with the two openings and the two holes aligned in all pairs along the sliding profiles and fixed profiles, respectively; and wherein the narrower contour of the openings of the sliding profiles is as wide as a thickness of teeth of the male elements of the joining pieces; and wherein separation between centers of the narrower contours of the openings of the sliding profiles define separation and parallelism between adjacent edges of consecutive construction elements.

13. The system according to claim 1, wherein the openings of the sliding profiles extend laterally on adjacent walls of said sliding profiles along edges of the wider contour of said openings; and wherein the holes of the fixed profiles extend laterally on adjacent walls of said fixed profiles along an entire length of said holes.

14. The system according to claim 1, wherein the sliding profiles have, between consecutive openings, a first slit, oriented to receive an end of a tool for propelling of a sliding profile, accessible through a second slit of the fixed profiles, opposite said first slit, the second slit being long enough to allow access of the tool to the first slit and movement of said tool and of the sliding profile between the inactive position and the retention position of said sliding profile.

15. The system according to claim 1, wherein the fixed profiles of the anchoring pieces have a flat central web, which ends longitudinally by folds towards a same side, which define opposite channels; and wherein the sliding profile has a rectangular omega-shaped section, having a width slightly smaller than an inner width of the fixed profile, and having flanges housed in the channels of said fixed profiles.

16. The system according to claim 15, wherein outer wall of one of the opposite channels of the fixed profile of the anchoring pieces has, from a free edge, L-shaped cuts which determine flexible longitudinal pins; and wherein the sliding profiles have flat tabs, at least in the flange adjacent to the channel with L-shaped cuts, the flat tabs having a number and separation coinciding with said L-shaped cuts, to be inserted in the channel which has the flexible longitudinal pins, by the bending of said pins.

17. The system according to claim 9, wherein part of the coplanar teeth are folded 180°, generating coplanar teeth which are in coplanar position and in an opposite direction with respect to the unfolded teeth.

* * * * *